US010526730B2

(12) United States Patent
Weeks et al.

(10) Patent No.: US 10,526,730 B2
(45) Date of Patent: Jan. 7, 2020

(54) TREATMENT OF TOUGH INORGANIC FIBERS AND THEIR USE IN A MOUNTING MAT FOR EXHAUST GAS TREATMENT DEVICE

(71) Applicant: Unifrax I LLC, Tonawanda, NY (US)

(72) Inventors: Kelvin Weeks, Runcorn (GB); Adam Kelsall, Runcorn (GB)

(73) Assignee: UNIFRAX I, LLC, Tonawanda, NY (US)

( * ) Notice: Subject to any disclaimer, the term of this patent is extended or adjusted under 35 U.S.C. 154(b) by 541 days.

(21) Appl. No.: 14/069,887

(22) Filed: Nov. 1, 2013

(65) Prior Publication Data

US 2014/0127083 A1 May 8, 2014

Related U.S. Application Data

(60) Provisional application No. 61/721,991, filed on Nov. 2, 2012.

(51) Int. Cl.
*D01D 11/02* (2006.01)

(52) U.S. Cl.
CPC ..... *D01D 11/02* (2013.01)

(58) Field of Classification Search
CPC ..... D01D 11/02; D21H 13/38; D21H 13/40; D21H 13/36; D21H 13/50; D04H 1/4209; D04H 1/72; F01N 3/2857
See application file for complete search history.

(56) References Cited

U.S. PATENT DOCUMENTS 3,458,329 A 7/1969 Owens et al.
3,544,414 A * 12/1970 Simison ..... D04H 1/72 19/305

(Continued)

FOREIGN PATENT DOCUMENTS

CN 101883666 A 11/2010
CN 102207018 A 10/2011

(Continued)

OTHER PUBLICATIONS

International Search Report, Form PCT/ISA/210, dated Jan. 23, 2014, for corresponding PCT International Patent Application No. PCT/IB2013/059847.

(Continued)

*Primary Examiner* — Anthony D Stashick
*Assistant Examiner* — Onekki P Jolly
(74) *Attorney, Agent, or Firm* — Haynes and Boone, LLP

(57) ABSTRACT

A method of treating tough inorganic fiber bundles including opening a plurality of the tough inorganic fiber bundles such that tough inorganic fibers can be dispersed in a liquid slurry to lay down a homogenous fiber aggregate, wherein the tough inorganic fibers have a crush settle volume of greater than 250 ml, optionally greater than 450 ml. Also, a method of treating tough inorganic fiber bundles including dispersing a plurality of the tough inorganic fiber bundles in a slurry with a dilution of about 0.1% to about 2%, optionally about 0.1% to about 1%, effective to lay down a homogenous fiber aggregate, wherein the tough inorganic fibers have a crush settle volume of greater than 250 ml, optionally greater than 450 ml.

29 Claims, 1 Drawing Sheet

(56) References Cited

U.S. PATENT DOCUMENTS 3,920,507 A * 11/1975 Yonemori ..... D01D 5/11 162/157.5
3,943,220 A * 3/1976 Barnett ..... D02G 3/20 264/103
3,989,588 A * 11/1976 Charters ..... D21B 1/12 162/234
4,260,452 A * 4/1981 Kruger ..... D21C 5/00 162/23
4,520,124 A * 5/1985 Abe ..... B01D 53/9418 156/89.26
5,190,571 A 3/1993 Fay et al.
5,258,164 A 11/1993 Bloom et al.
5,332,699 A 7/1994 Olds et al.
5,380,580 A * 1/1995 Rogers ..... D04H 1/42 156/148
5,585,312 A 12/1996 TenEyck et al.
5,666,726 A * 9/1997 Robinson ..... B01D 53/9454 29/428
5,714,421 A 2/1998 Olds et al.
5,811,360 A 9/1998 Jubb
5,821,183 A 10/1998 Jubb
5,869,010 A 2/1999 Langer
5,874,375 A 2/1999 Zoitos et al.
5,883,023 A 3/1999 Martine et al.
5,928,975 A 7/1999 Jubb
5,955,389 A 9/1999 Jubb
5,972,434 A 10/1999 Kajander
6,025,288 A 2/2000 Zoitos et al.
6,030,910 A 2/2000 Zoitos et al.
6,183,852 B1 * 2/2001 Rorabaugh ..... C04B 14/24 264/621
6,224,835 B1 5/2001 Langer
6,365,267 B1 * 4/2002 Langer ..... B01D 53/88 428/324
6,458,418 B2 * 10/2002 Langer ..... B01D 53/88 427/376.1
6,468,932 B1 * 10/2002 Robin ..... C03C 13/00 216/97
6,706,945 B1 * 3/2004 Melius ..... A61F 13/15203 604/367
6,861,381 B1 3/2005 Jubb et al.
6,953,757 B2 10/2005 Zoitos et al.
7,153,796 B2 12/2006 Jubb et al.
7,259,118 B2 8/2007 Jubb et al.
7,550,118 B2 6/2009 Merry
7,600,489 B2 10/2009 Lomax, Jr. et al.
7,785,544 B2 * 8/2010 Alward ..... B01D 39/2082 422/179
8,007,732 B2 8/2011 Beauharnois
8,124,022 B2 2/2012 Howorth et al.
8,197,766 B2 6/2012 Tomosue et al.
2004/0134172 A1 * 7/2004 Kumar ..... B01D 46/0001 55/523
2004/0234436 A1 11/2004 Howorth
2005/0022415 A1 * 2/2005 Yancey ..... C04B 18/241 34/221
2008/0124576 A1 5/2008 Elliott
2008/0302494 A1 * 12/2008 Nunn ..... D21H 13/08 162/146
2009/0208732 A1 8/2009 Middendorf et al.
2009/0320428 A1 12/2009 Soyama et al.
2011/0061214 A1 * 3/2011 Wirtz ..... D01G 25/00 28/104
2011/0226547 A1 * 9/2011 Kuhl ..... B32B 5/022 181/294
2012/0015176 A1 1/2012 Riebel et al.
2012/0107547 A1 * 5/2012 Fernando ..... B32B 5/24 428/76
2012/0149271 A1 6/2012 Sugino et al.

FOREIGN PATENT DOCUMENTS

CN 102271781 A 12/2011
EP 2 372 004 A1 10/2011
JP H05-163695 A 6/1993
JP 2009-041468 A 2/2009
JP 2009-079597 A 4/2009
JP 2009-132156 A 6/2009
JP 2010-538205 A 12/2010
JP 2011-026755 A 2/2011
WO WO 2005/113126 A1 12/2005
WO WO 2009/048854 A1 4/2009
WO WO 2010/077360 A2 7/2010
WO WO 2009/119054 A1 7/2011
WO WO 2012/009528 A1 1/2012

OTHER PUBLICATIONS

Written Opinion, Form PCT/ISA/237, dated Jan. 23, 2014, for corresponding PCT International Patent Application No. PCT/IB2013/059847.
Chinese Office Action for corresponding Chinese Application No. 201380057306.4, dated Jul. 14, 2016.
WO 2009/0119054 A1, US 2009/0320428 A1.
JP 2009-041468 A, U.S. Pat. No. 8,197,766 B2.
JP 2011-026755 A, US 2012/0149271 A1.
JP 2009-079597 A, US 2004/0134172 A1.
Office Action for corresponding Japanese patent application, JP 2015-540257, dated Sep. 27, 2017.
Office Action for corresponding Japanese Patent Application No. JP 2015-540257, dated Sep. 27, 2017.
Notice of Reasons for Revocation in Japan Patent No. 6444878, dated Aug. 26, 2019, including partial English translation.
Notice of Grounds for Rejection in Korean Patent Application No. 10-2015-7011363, dated Sep. 23, 2019, including English translation.

* cited by examiner

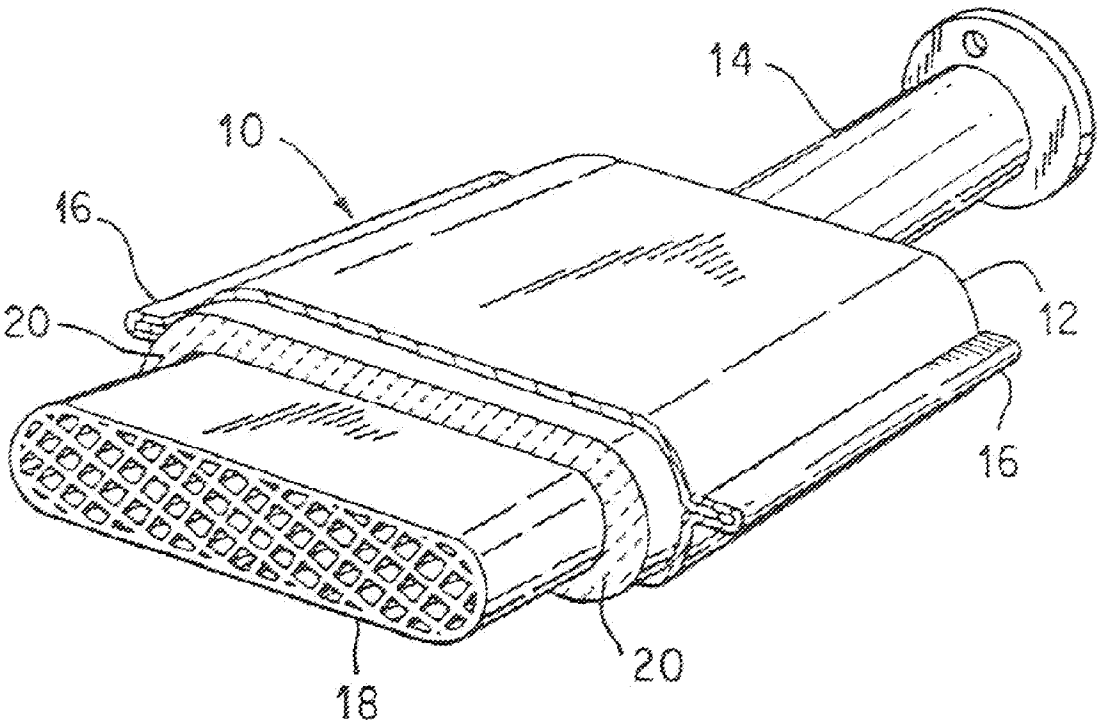
10
14
12
16
20
18
16
20

TREATMENT OF TOUGH INORGANIC FIBERS AND THEIR USE IN A MOUNTING MAT FOR EXHAUST GAS TREATMENT DEVICE

This application claims the benefit of the filing date under 35 U.S.C. 119(e) from U.S. Provisional Application For Patent Ser. No. 61/721,991 filed on Nov. 2, 2012.

Polycrystalline wool fibers are high performance fibers (also referred to herein as "tough inorganic fibers") which may comprise a composition in the range of about 1 to about 28 weight percent $SiO_2$, and about 72 to about 99 weight percent $Al_2O_3$, optionally with mean fiber diameters in the range of about 3 to about 10 μm. High performance fibers differ in properties from conventional refractory ceramic fibers which comprise from about 40 weight percent to about 60 weight percent $Al_2O_3$ and about 60 weight percent to about 40 weight percent $SiO_2$. The toughness of high performance fibers makes them desirable for use in insulating and supportive articles such as mounting mats for exhaust gas treatment devices.

Exhaust gas treatment devices are used on automobiles to reduce atmospheric pollution from engine emissions. Examples of widely used exhaust gas treatment devices include catalytic converters and diesel particulate traps.

An illustrative catalytic converter for treating exhaust gases of an automotive engine includes a housing, a fragile catalyst support structure for holding the catalyst that is used to effect the oxidation of carbon monoxide and hydrocarbons and the reduction of oxides of nitrogen, and a mounting mat disposed between the outer surface of the fragile catalyst support structure and the inner surface of the housing to resiliently hold or support the fragile catalyst support structure within the housing.

An illustrative diesel particulate trap for controlling pollution generated by diesel engines generally includes a housing, a fragile particulate filter or trap for collecting particulate from the diesel engine emissions, and a mounting mat that is disposed between the outer surface of the filter or trap and the inner surface of the housing, to resiliently hold the fragile filter or trap structure within the housing.

The fragile catalyst support structure generally comprises a monolithic structure manufactured from a frangible material of metal or a brittle, ceramic material. These fragile catalyst support structures provide a plurality of gas flow channels. The catalyst support structures can be so fragile that even small shock loads or stresses are often sufficient to crack or crush them. Metallic catalyst support structures may also be mounted within a metal housing utilizing a mounting mat.

In order to protect the fragile catalyst support structure from thermal and mechanical shock and other stresses, as well as to provide thermal insulation and a gas seal, a mounting mat is positioned within the gap between the fragile structure and the housing.

The mounting mat materials employed should be capable of satisfying any of a number of design or physical requirements set forth by the fragile structure manufacturers or the exhaust gas treatment device manufacturers. For example, the mounting mat material should be capable of exerting an effective residual holding pressure on the fragile structure, even when the exhaust gas treatment device has undergone wide temperature fluctuations, which causes significant expansion and contraction of the metal housing in relation to the fragile structure, which in turn causes significant compression and release cycles for the mounting mats over a period of time.

A mounting mat may be produced in any way known in the art for forming sheet-like materials. For example, conventional paper-making processes, either hand laid or machine laid, may be used to prepare the sheet material. A handsheet mold, a Fourdrinier paper machine, or a roto-former paper machine can be employed to make the sheet material.

For example, using a papermaking process, inorganic fibers, intumescent material, and an antioxidant may be mixed together with a binder or other fibers capable of acting as a binder to form a mixture or slurry. The slurry of components may be flocculated by adding a flocculating agent to the slurry. The flocculated mixture or slurry is placed onto a papermaking machine to be formed into a ply or sheet of fiber containing paper. The sheet is dried by air drying or oven drying.

Alternatively, plies or sheets may be formed by vacuum casting the slurry. According to this method, the slurry of components is wet laid onto a pervious web. A vacuum is applied to the web to extract the majority of the moisture from the slurry, thereby forming a wet sheet. The wet plies or sheets are then dried, typically in an oven. The sheet may be passed through a set of rollers to compress the sheet prior to drying. For a more detailed description of standard papermaking techniques employed, see U.S. Pat. No. 3,458,329.

Wet-laid intumescent or non-intumescent mats may be produced as a layer, or layers, on a papermaking or vacuum casting device. It has been found that the performance of the mounting mat can be significantly improved if the mat is comprised of at least one layer of homogenous tough inorganic fiber aggregate. A mat comprised of at least one layer of homogenous tough inorganic fiber aggregate has been found to exhibit a greater coefficient of friction and to exceed the pressure performance of a conventional mat. For example, the cyclic pressure performance of a traditional wet-laid mounting mat comprised of conventional polycrystalline wool fibers may average approximately 90 kPa, whereas a wet-laid mat comprised of a homogenous layer of opened tough inorganic fibers has been found to demonstrate a cyclic resiliency of up to about 145 kPa or greater.

Wet laid mats are typically uniform in basis weight and thickness distribution. In a wet laid system, with the aid of proper dilution levels and dispersing chemicals, a uniform sheet can be produced. Conventional inorganic fibers are well suited for a wet-laid process because the fibers are frangible and break, or are easily cut, and disperse evenly in a liquid without difficulty.

In contrast to conventional inorganic fibers, tough inorganic fibers are strong, exceptionally resilient, and tend to bend rather than break. The use of tough fibers in a papermaking process is problematic because the high resiliency fibers become entangled, forming bundles and clumps that do not break apart and disperse evenly in a slurry. Therefore, it is difficult to achieve a uniform sheet of evenly dispersed, tough inorganic fibers. This uneven distribution of fibers results in a reduction in the performance that would otherwise be achieved through the use of tough inorganic fibers in a fiber aggregate, such as a mounting mat discussed above or other insulative or fire resistant fiber aggregate.

Opening the tough inorganic fiber bundles minimizes bunching, balling and intertwining of the fibers and allows the fibers to be more evenly dispersed throughout a fiber aggregate, such as a paper, mat, blanket or the like. Opened tough inorganic fibers separate from each other during mixing so that each individual fiber may disperse and contribute to the overall performance of the mounting mat product. A mat comprised of at least one layer of homogenous tough inorganic fiber aggregate may exhibit increased resiliency, flexibility and ability to wrap a catalyst support structure without cracking, when compared to a mat prepared with entangled tough inorganic fibers that are not well dispersed.

The challenge is to prepare or treat the tough inorganic fiber bundles so that a homogenous fiber aggregate may be achieved without destroying the integrity, or morphology, of the fibers, to prevent loss of their high performance properties.

Well dispersed tough fibers may have a relatively long length and exhibit a high crush settle volume when subjected to the crush settle volume test. Shorter fibers pack more densely resulting in a lower crush settle volume. A higher fiber crush settle volume may be correlated to improved pressure performance of a mat comprised of at least one layer of homogenous tough inorganic fiber aggregate.

FIG. 1 shows a fragmentary view of an illustrative exhaust gas treatment device including the subject mounting mat.

For the purposes of this disclosure, a "tough" inorganic fiber may also be referred to as "high resiliency" inorganic fiber, or a "high performance" inorganic fiber.

For the purposes of this disclosure, a "tough" inorganic fiber is defined as an inorganic fiber that, when tested according to a crush settle volume test, a 5 g sample of the tough inorganic fiber placed within a stainless steel holder displays a crush settle volume greater than 250 ml, optionally greater than 450 ml, after a 1.4 kN load is applied for 5 minutes.

For the purposes of this disclosure, "opening" a tough inorganic fiber is defined as mechanically altering tough inorganic fibers, and/or fiber bundles, while retaining the desirable physical properties of the fibers such as length, diameter, resiliency, and cyclic performance. An "opened" fiber is defined as a fiber that has been subjected to an opening process.

A method of treating tough inorganic fiber bundles is provided. In an illustrative embodiment, involving fiber that, according to a crush settle volume test, a 5 g sample of the tough inorganic fiber placed within a stainless steel holder displays a crush settle volume greater than 250 ml, optionally greater than 450 ml, after a 1.4KN load is applied for 5 minutes, the method comprises opening a plurality of the tough inorganic fiber bundles such that tough inorganic fiber can be dispersed in a liquid slurry to lay down a homogenous fiber aggregate.

A method for making a mounting mat for an exhaust gas treatment device is also provided. In an embodiment, a method for making a mounting mat for an exhaust gas treatment device comprises preparing a slurry of opened tough inorganic fibers and a liquid, and removing at least a portion of the liquid from the slurry to form a wet-laid layer containing the opened tough inorganic fibers.

A mounting mat for use in exhaust gas treatment device applications is further provided. In an embodiment, the mounting mat comprises a homogenous tough inorganic fiber aggregate, such as a layer prepared from a slurry of opened tough inorganic fibers and a liquid, wherein at least a portion of the liquid is removed from the slurry to form the wet-laid layer containing the opened tough inorganic fibers. According to certain embodiments, the mounting mat may include an intumescent material, optionally in the layer containing the opened tough inorganic fiber.

A device for treating exhaust gases is also provided. In accordance with an embodiment, the device includes a housing; a fragile structure resiliently mounted within the housing; and a mounting mat comprising a homogenous layer of tough inorganic fiber aggregate, such as the layer of opened tough inorganic fibers described above. The term "fragile structure" is intended to mean and include structures such as metal or ceramic monoliths or the like, which may be fragile or frangible in nature, and would benefit from a mounting mat such as is described herein.

An illustrative form of a device for treating exhaust gases is designated by the numeral 10 in FIG. 1. It should be understood that the mounting mat is not intended to be limited to use in the device shown in FIG. 1, and so the shape is shown only as an illustrative embodiment. In fact, the mounting mat could be used to mount or support any fragile structure suitable for treating exhaust gases, such as a diesel catalyst structure, a diesel particulate trap, and the like.

According to certain embodiments, catalytic converter 10 may include a housing 12 formed of two pieces of metal, for example, high temperature resistant steel, held together by flange 16. Alternatively, the housing may include a preformed canister into which a mounting mat-wrapped fragile structure is inserted. Housing 12 includes an inlet 14 at one end and an outlet (not shown) at its opposite end. The inlet 14 and outlet are suitably formed at their outer ends whereby they may be secured to conduits in the exhaust system of an internal combustion engine. Device 10 contains a fragile structure, such as a frangible ceramic monolith 18, which is supported and restrained within housing 12 by a mounting mat 20. Monolith 18 includes a plurality of gas pervious passages that extend axially from its inlet at one end to its outlet at its opposite end. Monolith 18 may be constructed of any suitable refractory metal or ceramic material in any known manner and configuration. Monoliths are typically oval or round in cross-sectional configuration, but other shapes are possible.

The monolith is spaced from inner surfaces of the housing by a distance or a gap, which will vary according to the type and design of the device utilized, for example, a catalytic converter, a diesel catalyst structure, or a diesel particulate trap. This gap is filled with a mounting mat 20 to provide resilient support to the ceramic monolith 18. The resilient mounting mat 20 provides both thermal insulation to the external environment and mechanical support to the fragile structure, thereby protecting the fragile structure from mechanical shock across a wide range of exhaust gas treatment device operating temperatures.

In general, the mounting mat comprises opened tough inorganic fibers, and may include an organic binder optionally adapted to be sacrificially burned out. The mounting mat 20 is capable of providing a holding pressure sufficient to resiliently hold the fragile catalyst support structure 18 within a housing 12 of an exhaust gas treatment device 10 throughout a wide temperature range.

Any resilient, high performance or tough inorganic fibers may be utilized in the mounting mat so long as the fibers can withstand the mounting mat forming process, can withstand the operating temperatures of the exhaust gas treatment devices, and can provide the minimum holding pressure performance for holding fragile structure within the exhaust gas treatment device housing at the operating temperatures.

Without limitation, suitable tough inorganic fibers that may be opened and used to prepare the homogenous fiber aggregate include, for example, high alumina polycrystalline fibers, polycrystalline wools, carbon fibers, mullite fibers, alumina-magnesia-silica fibers, S-glass fibers, S2-glass fibers, E-glass fibers, R-glass fibers, quartz fibers, silica fibers and combinations thereof. In an embodiment, a polycrystalline wool fiber may comprise a composition in the range of about 1-28% $SiO_2$, and 72-99% $Al_2O_3$, optionally with mean fiber diameters in the range of about 3-10 μm.

Suitable silica fibers useful in the production of a mounting mat for an exhaust gas treatment device include those leached glass fibers available from BelChem Fiber Materials GmbH, Germany, under the trademark BELCOTEX, from Hitco Carbon Composites, Inc. of Gardena Calif., under the registered trademark REFRASIL, and from Polotsk-Steklovolokno, Republic of Belarus, under the designation PS-23™.

The BELCOTEX fibers are standard type, staple fiber pre-yarns. These fibers have an average fineness of about 550 tex and are generally made from silicic acid modified by alumina. The BELCOTEX fibers are amorphous and generally contain about 94.5 silica, about 4.5 percent alumina, less than 0.5 percent sodium oxide, and less than 0.5 percent of other components. These fibers have an average fiber diameter of about 9 microns and a melting point in the range of 1500° to 1550° C. These fibers are heat resistant to temperatures of up to 1100° C., and are typically shot free and binder free.

The REFRASIL fibers, like the BELCOTEX fibers, are amorphous leached glass fibers which have a high silica content for providing thermal insulation for applications in the 1000° C. to 1100° C. temperature range. These fibers are between about 6 and about 13 microns in diameter, and have a melting point of about 1700° C. The fibers, after leaching, typically have a silica content of about 95 percent by weight. Alumina may be present in an amount of about 4% by weight with other components being present in an amount of 1% or less.

The PS-23™ fibers from Polotsk-Steklovolokno are amorphous glass fibers high in silica content and are suitable for thermal insulation for applications requiring resistance to at least about 1000° C. These fibers have a fiber length in the range of about 5 to about 20 mm and a fiber diameter of about 9 microns. These fibers, like the REFRASIL fibers, have a melting point of about 1700° C.

The E-glass fiber typically comprises from about 52 weight percent to about 56 weight percent $SiO_2$, from about 16 weight percent to about 25 weight percent CaO, from about 12 weight percent to about 16 weight percent $Al_2O_3$, from about 5 weight percent to about 10 weight percent $B_2O_3$, up to about 5 weight percent MgO, up to about 2 weight percent of sodium oxide and potassium oxide and trace amounts of iron oxide and fluorides, with a typical composition of 55 weight percent $SiO_2$, 15 weight percent $Al_2O_3$, 7 weight percent $B_2O_3$, 3 weight percent MgO, 19 weight percent CaO and traces of the above mentioned materials.

According to certain embodiments, additional heat resistant inorganic fibers that may also be used to prepare the mounting mat comprise ceramic fibers, alkaline silicate fibers, alkaline earth silicate wool, alkaline earth silicate fibers such as calcia-magnesia-silica fibers and magnesia-silica fibers. Without limitation, suitable ceramic fibers include alumina fibers, alumina-silica fibers, alumina-zirconia-silica fibers, zirconia-silica fibers, zirconia fibers and similar fibers. A useful alumina-silica ceramic fiber is commercially available from Unifrax I LLC (Niagara Falls, N.Y.) under the registered trademark FIBERFRAX. The FIBERFRAX ceramic fibers comprise the fiberization product of about 45 to about 75 weight percent alumina and about 25 to about 55 weight percent silica. The FIBERFRAX fibers exhibit operating temperatures of up to about 1540° C. and a melting point up to about 1870° C. The FIBERFRAX fibers are easily formed into high temperature resistant sheets and papers.

Without limitation, suitable examples of biosoluble alkaline earth silicate fibers that can be used to prepare a mounting mat for an exhaust gas treatment device include those fibers disclosed in U.S. Pat. Nos. 6,953,757, 6,030,910, 6,025,288, 5,874,375, 5,585,312, 5,332,699, 5,714,421, 7,259,118, 7,153,796, 6,861,381, 5,955,389, 5,928,975, 5,821,183, and 5,811,360, which are incorporated herein by reference.

According to certain embodiments, the biosoluble alkaline earth silicate fibers may comprise the fiberization product of a mixture of oxides of magnesium and silica. These fibers are commonly referred to as magnesium-silicate fibers. The magnesium-silicate fibers generally comprise the fiberization product of about 60 to about 90 weight percent silica, from greater than 0 to about 35 weight percent magnesia and 5 weight percent or less impurities. According to certain embodiments, the heat treated alkaline earth silicate fibers comprise the fiberization product of about 65 to about 86 weight percent silica, about 14 to about 35 weight percent magnesia and 5 weight percent or less impurities. According to other embodiments, the heat treated alkaline earth silicate fibers comprise the fiberization product of about 70 to about 86 weight percent silica, about 14 to about 30 weight percent magnesia, and 5 weight percent or less impurities. A suitable magnesium-silicate fiber is commercially available from Unifrax I LLC (Niagara Falls, N.Y.) under the registered trademark ISOFRAX. Commercially available ISOFRAX fibers generally comprise the fiberization product of about 70 to about 80 weight percent silica, about 18 to about 27 weight percent magnesia and 4 weight percent or less impurities.

According to certain embodiments, the biosoluble alkaline earth silicate fibers may comprise the fiberization product of a mixture of oxides of calcium, magnesium and silica. These fibers are commonly referred to as calcia-magnesia-silica fibers. According to certain embodiments, the calcia-magnesia-silica fibers comprise the fiberization product of about 45 to about 90 weight percent silica, from greater than 0 to about 45 weight percent calcia, from greater than 0 to about 35 weight percent magnesia, and 10 weight percent or less impurities. Useful calcia-magnesia-silicate fibers are commercially available from Unifrax I LLC (Niagara Falls, N.Y.) under the registered trademark INSULFRAX. INSULFRAX fibers generally comprise the fiberization product of about 61 to about 67 weight percent silica, from about 27 to about 33 weight percent calcia, and from about 2 to about 7 weight percent magnesia. Other suitable calcia-magnesia-silicate fibers are commercially available from Thermal Ceramics (Augusta, Ga.) under the trade designations SUPERWOOL 607, SUPERWOOL 607 MAX and SUPERWOOL HT. SUPERWOOL 607 fibers comprise about 60 to about 70 weight percent silica, from about 25 to about 35 weight percent calcia, from about 4 to about 7 weight percent magnesia, and trace amounts of alumina. SUPERWOOL 607 MAX fibers comprise about 60 to about 70 weight percent silica, from about 16 to about 22 weight percent calcia, and from about 12 to about 19 weight percent magnesia, and trace amounts of alumina. SUPERWOOL HT fiber comprise about 74 weight percent silica, about 24 weight percent calcia and trace amounts of magnesia, alumina and iron oxide.

The alumina/silica refractory ceramic fiber (RCF) may comprise from about 40 weight percent to about 60 weight percent $Al_2O_3$ and about 60 weight percent to about 40 weight percent $SiO_2$. The fiber may comprise about 50 weight percent $Al_2O_3$ and about 50 weight percent $SiO_2$. The alumina/silica/magnesia glass fiber typically comprises from about 64 weight percent to about 66 weight percent $SiO_2$, from about 24 weight percent to about 25 weight percent $Al_2O_3$, and from about 9 weight percent to about 10 weight percent MgO.

Tough inorganic fibers may exhibit desirable qualities, for example, strength and toughness. However, tough fibers are characteristically long and somewhat tangled when produced. The mixing step of the wet-laid papermaking process further tangles and bunches the fibers. Conventional fibers are brittle and can be bladed in the mixer to cut them apart so that they disperse evenly. On the other hand, tough inorganic fibers are resilient and tangle up in the mixer, making them unsuitable for use in a wet-laid papermaking process.

A homogenous fiber aggregate may comprise evenly dispersed opened tough inorganic fibers. Tough inorganic fiber bundles may be separated by opening the fibers. Tough inorganic fibers, or fiber bundles, may be opened utilizing any method capable of separating the individual fibers without impairing the desirable qualities of the fiber.

In an embodiment, a plurality of tough inorganic fibers may be included in a slurry and wet opened. The fiber concentration of the slurry may be varied. Wet opening the tough inorganic fibers may open the fiber bundles while substantially retaining the length of the fibers. In other embodiments, the length of the fibers may be shortened by chopping the fibers after production, to be followed by wet opening the tough inorganic fiber bundles.

The tough inorganic fibers may be opened by disc refining a low dilution tough inorganic fiber slurry, such as about 0.1% to about 1% fibers by mass. For example, a disc refiner may comprise a fixed disc and a rotating disc that imparts a shearing energy on the fiber slurry. The surface detail and structure of the discs may be used to disperse and open the fibers. In another embodiment, the tough inorganic fibers may be opened by de-flaking a low dilution slurry.

In further embodiments, the tough inorganic fibers may be opened by hydropulping a fiber slurry. For example, the rotating blade and baffles of a hydropulper may set up turbulent eddy currents, for example, utilizing a rotating blade and baffles, in a mixer to break up the fiber bundles and disperse the fibers.

The tough inorganic fibers may be opened by beating the tough inorganic fibers. For example, beaters may comprise a paddle wheel plate that rotates against a fixed base plate. The gap between the rotating plate and the fixed plate may be adjusted to optimize dispersal of the fiber bundles.

In accordance with an embodiment, a plurality of tough inorganic fibers may be dry opened. In certain embodiments, dry opening the tough inorganic fibers may open the fiber bundles while substantially retaining the length of the fibers. In other embodiments, dry opening the tough inorganic fibers may comprise opening the fiber bundles and shortening the length of the individual fibers.

The tough inorganic fibers may be dry opened by carding. Carding techniques may comprise subjecting dry fibers to a mechanical combing-type action. Pins may be dragged through the fibers, or a fiber blanket, to volumize and open the tough inorganic fibers. Carding of the blanket may be optionally followed with chopping the carded blanket.

In an embodiment, the tough inorganic fibers may be dry opened by milling. The fibers may be milled utilizing an attrition mill combination fiber picker. The attrition mill combination fiber picker may disperse the fiber bundles and/or reduce the fiber length by grinding the fiber bundles. An attrition mill combination fiber picker may comprise a fixed disc and a rotating disc that imparts a shearing energy on the dry fibers. Disc refining may be utilized to disperse the fiber bundles and/or shorten the fibers.

The tough inorganic fibers may be dry opened by milling with a hammer mill and/or ROTOPLEX® granular cutting mill. The tough inorganic fibers may be struck by hammers which are attached to a shaft that rotates at a high speed inside the grinding chamber of a hammer mill. The fibers are opened by repeated hammer impacts. A ROTOPLEX® granular cutting mill may open tough inorganic fiber bundles and shorten the individual fibers utilizing a cross-scissor-cut rotor with segmented knives.

As discussed above, the tough inorganic fibers may be shortened by chopping or cutting. In some embodiments, the tough inorganic fibers may be chopped prior to opening the tough inorganic fibers. The fibers may be chopped utilizing any suitable chopping or cutting method, for example, die cutting, guillotine chopping and/or waterjet cutting. The tough inorganic fibers may be chopped, or cut, in connection with the fiber manufacturing process when the fibers have directionality, or are laminar, rather than randomly arranged. Reducing the fiber length may reduce the energy required to open the fiber bundles and may prevent additional tangling in the pulping step in the paper-making process.

In an embodiment, the tough inorganic fibers may be disposed in a sheet or blanket. Shortening the fibers may comprise die cutting the sheets of tough inorganic fibers into, for example, 5 cm squares, such that the fibers do not exceed 5 cm in length. In other embodiments, the fibers may be cut or chopped into smaller squares, for example, 2 cm squares or smaller. The fibers may be shortened by cross-cutting a tough inorganic fiber sheet or blanket into strips.

In certain embodiments, the tough inorganic fibers may be shortened to a particular length by chopping or cutting. The chopped or cut tough inorganic fibers optionally may not be further substantially shortened by any subsequent processing, for example, by opening of the fibers, so as to take advantage of the properties of a longer fiber.

In a further embodiment, low dilution, i.e. low concentration, such as about 0.1% to about 1% by mass of the tough inorganic fibers, of the fiber slurry may allow the tough inorganic fibers to separate so that tangling and intertwining of the tough inorganic fibers is minimized.

In other embodiments, high dilution, i.e. high concentration, such as about 1% to about 2% by mass of the tough inorganic fibers, of the fiber slurry may allow for greater fiber interaction. Greater fiber interaction may improve the efficiency of a fiber shortening step by increasing the energy transfer per unit fiber mass.

The competing effects of low dilution and high dilution may be combined to optimize the overall effect, for example, by utilizing a gradual addition of fiber to the slurry.

In an embodiment, an exemplary tough inorganic fiber slurry dilution comprises a dilution in the range of about 0.1% to about 2% by mass, optionally about 0.1% to about 1% by mass, of the tough inorganic fibers. In certain embodiments, the tough inorganic fibers may be chopped before dilution.

The pressure performance of a wet-laid mat may be correlated to the results of a Settle Height Test and or a Crush Settle Volume Test. The Settle Height Test may be conducted by removing any binder material, for example, the binder may be burnt out, from a sample of mat material including tough inorganic fibers. Both the Settle Height Test and the Crush Settle Volume Test may be conducted using a sample of tough inorganic fibers which have not been processed into a fiber article, such as mounting mat material. Regardless of the source of the tough inorganic fibers, a 5 g sample of tough inorganic fibers is weighed out. The 5 g of tough inorganic fibers is then added to 400 ml of water and stirred at 1,000 rpm for 2 minutes using a paddle stirrer. Without limitation, a suitable paddle stirrer may include a four-bladed stirrer from VWR International LLC, having a 50 mm paddle diameter, 8 mm shaft diameter, and total shaft length of 450 mm. The dispersed fibers, including the water, are transferred to a 1,000 ml cylinder and filled to 1,000 ml with additional water. Without limitation, a suitable 1,000 ml cylinder is a low-form beaker with a height of 147 mm and an external diameter of 109 mm. The cylinder is then stoppered and inverted 10 times. The stopper is removed and the fibers are allowed to settle for 30 minutes. The settling volume is measured as the volume occupied by the settled, dispersed tough inorganic fibers in the 1 liter cylinder.

A Crush Settle Volume Test may be conducted similarly to the Settle Height Test, except that the 5 g sample of tough inorganic fibers is placed into a tube having an internal diameter of 37.5 mm and compressed at 1.4 kN for five minutes prior to being added to the 400 ml of water and stirred. The crush settle volume is measured as the volume occupied by the crushed, settled and dispersed tough inorganic fibers in the 1 liter cylinder.

A settle volume of greater than 250 ml may be associated with a pressure performance of 90 kPa for fibers having a crush settle volume of less than 250 ml. Fibers having a crush settle volume and settle volume of greater then 450 ml may be associated with a pressure performance, or cyclic resiliency, of greater than 120 kPa.

EXPERIMENTAL

The following examples are set forth merely to further illustrate the mounting mat comprised of opened tough inorganic fibers for an exhaust gas treatment device. The illustrative examples should not be construed as limiting the mounting mat, exhaust gas treatment device incorporating the mounting mat, or the methods of making the mounting mat or the exhaust gas treatment device in any manner.

Comparative Example 1

Tough inorganic fibers having a crush settle volume of greater than 450 ml and a settle volume of 350 ml were used to construct a sample wet-laid mat. The mat was prepared utilizing a conventional paper-making process with no additional fiber pre-chopping or tough fiber opening techniques.

Example 2

Tough inorganic fibers having a crush settle volume of greater than 450 ml and a settle volume of 400 ml were used to construct a sample wet-laid mat. The tough inorganic fibers were subjected to a dry opening technique. A dry bale opener type machine was utilized to disperse and/or open the fiber bundles.

Example 3

Tough inorganic fibers having a crush settle volume of greater than 450 ml and a settle volume of 400 ml were used to construct a sample wet-laid mat. The tough inorganic fibers were subjected to a dry opening technique. A carding type machine was utilized to disperse and/or open the fiber bundles.

Example 4

Tough inorganic fibers having a crush settle volume of greater than 450 ml were used to construct a sample wet-laid mat. The tough inorganic fibers were subjected to a wet opening technique. A ROTOPLEX® granular cutting mill was utilized to disperse and/or open the fiber bundles.

Example 5

Tough inorganic fibers having a crush settle volume of greater than 450 ml and a settle volume of 500 ml were used to construct a sample wet-laid mat. The tough inorganic fibers were cut to shorter lengths.

Example 6

Tough inorganic fibers having a crush settle volume of greater than 450 ml and a settle volume of 650 ml were used to construct a sample wet-laid mat. The tough inorganic fibers were subjected to a wet opening technique. A hydropulper with a high speed blade and baffles was utilized to disperse and/or open the fiber bundles.

Example 7

Tough inorganic fibers having a crush settle volume of greater than 450 ml and a settle volume of 400 ml were used to construct a sample wet-laid mat. The tough inorganic fibers were subjected to a wet opening technique. A Hollander beater comprising a beating roll with a matching grooved stainless steel bed plate was utilized to disperse and/or open the fiber bundles.

Example 8

Tough inorganic fibers having a crush settle volume of greater than 450 ml were used to construct a sample wet-laid mat. The tough inorganic fibers were subjected to a wet opening technique. A Disc Refiner comprising a series of plates which rotate against each other and through which the fiber slurry flows was utilized to disperse and/or open the fiber bundles.

Example 9

Tough inorganic fibers having a crush settle volume of greater than 450 ml and a settle volume of 420 ml were used to construct a sample wet-laid mat. The slurry dilution and flow characteristics were optimized during a pulper operation to disperse and/or open the fiber bundles.

Testing

The sample mats of Examples 1-5, were produced as described above and were tested using a 2500 Cycle Pressure Performance test. The tests were performed for 2500 mechanical cycles of a standard cycle pressure performance test conducted on a sample of mat material measuring 25 $cm^2$. The gap expansion was maintained at 8% and the test mat gap bulk density was 0.4 $g/cm^3$.

The sample mats of Examples 6-9, were produced as described above and were tested using a 1000 Cycle Pressure Performance test. The tests were performed for 1000 mechanical cycles of a standard cycle pressure performance test conducted on a sample of mat material measuring 50 $cm^2$. The gap expansion was maintained at 8% and the test mat gap bulk density was 0.4 $g/cm^3$. In general, the results of the 1000 Cycle Pressure Performance may be compared to the 2500 Cycle test results by subtracting 15 kPa from the 1000 Cycle test results.

By the term "cycle" it is meant that the gap between a fixed compression platen and a moving platen is opened and closed over a specific distance at a predetermined rate. The sample mats were placed within the gap between the moving and fixed platens. A 10 kN load cell was applied to the moving platen and the resulting pressure performance of the mat material measured.

It will be appreciated that one of ordinary skill in the art is able to conduct either the 1000 cycle test, or the 2500 cycle test, employing the above parameters without undue experimentation. That is, the above set parameters will enable one of ordinary skill in the art to make a like comparison of the effective pressure performance of a mat regardless of the characteristics of the mat or the size of the gap.

The pressure performance of each of the examples is reported in Table 1 below.

TABLE 1

| EXAMPLE | TEST | RESULT |
|---|---|---|
| Comparative Example 1 | 2500 cycle test | 95 kPa |
| Example 2 | 2500 cycle test | 125 kPa |
| Example 3 | 2500 cycle test | 105 kPa |
| Example 4 | 2500 cycle test | 102 kPa |
| Example 5 | 2500 cycle test | 106 kPa |
| Example 6 | 1000 cycle test | 140 kPa |
| Example 7 | 1000 cycle test | 150 kPa |
| Example 8 | 1000 cycle test | 145 kPa |
| Example 9 | 1000 cycle test | 135 kPa |

The wet-laid mat of Example 2, comprising a homogenous layer of opened tough inorganic fibers, demonstrated an increase of holding pressure of 26% over the mounting mat of Comparative Example 1 comprised of tough inorganic fibers that have not been opened. The range of tough inorganic fibers and opening techniques, utilized in Examples 2-5, demonstrated an increase of 7-26% in holding pressure.

Example 10

Tough inorganic fibers having a crush settle volume of greater than 450 ml were used to construct a sample wet-laid mat. The tough inorganic fiber material was cut into 2 cm squares and diluted in a slurry at 0.67% dilution.

Example 11

Tough inorganic fibers having a crush settle volume of greater than 450 ml were used to construct a sample wet-laid mat. The tough inorganic fiber material was cut into 2 cm squares and diluted in a slurry at 1% dilution.

Example 12

Tough inorganic fibers having a crush settle volume of greater than 450 ml were used to construct a sample wet-laid mat. The tough inorganic fiber material was cut into 5 cm squares and diluted in a slurry at 0.67% dilution.

Example 13

Tough inorganic fibers having a crush settle volume of greater than 450 ml were used to construct a sample wet-laid mat. The tough inorganic fiber material was cut into 5 cm squares and diluted in a slurry at 1% dilution.

Testing

The sample mats of Examples 10-13, were produced as described above and were tested using a 2500 Cycle Pressure Performance test. The tests were performed for 2500 mechanical cycles of a standard cycle pressure performance test conducted on a sample of mat material measuring 25 $cm^2$. The gap expansion was maintained at 8% and the test mat gap bulk density was 0.4 $g/cm^3$.

The pressure performance of each of the examples is reported in Table 2 below.

TABLE 2

| EXAMPLE | TEST | SETTLE HEIGHT | RESULT |
|---|---|---|---|
| Example 10 | 2500 cycle test | 580 mL | 143.09 kPa |
| Example 11 | 2500 cycle test | 540 mL | 150.98 kPa |
| Example 12 | 2500 cycle test | 575 mL | 137.55 kPa |
| Example 13 | 2500 cycle test | 515 mL | 133.81 kPa |

The test results demonstrate the effect of fiber cutting or pre-chopping and dilution of a tough inorganic fiber slurry on the settle height and pressure performance of a mat.

Example 14

Conventional inorganic fibers having a crush settle volume of less than 250 ml were used to construct a sample wet-laid mat comprising a homogenous layer of inorganic fibers.

Example 15

Tough inorganic fibers having a crush settle volume of greater than 450 ml that were pre-chopped were used to construct a sample wet-laid mat comprising a homogenous layer of tough inorganic fibers.

Testing

The sample mats of Examples 14 and 15, were produced as described above and the thickness, or free height, of the mat was measured before and after a binder burn out step.

The free height, or thickness, of each of the examples is reported in Table 3 below.

TABLE 3

| EXAMPLE | MAT FREE HEIGHT Prior to Binder Burnout | MAT FREE HEIGHT Post Binder Burnout |
|---|---|---|
| Example 14 | 8.88 mm | 17.13 mm |
| Example 15 | 10.79 mm | 21.37 mm |

The layers of homogenous tough inorganic fiber aggregate can be cut, such as by die stamping, and optionally stacked, and further optionally needled, to form mounting mats of exact shapes and sizes with reproducible tolerances. The mounting mats described above are advantageous to the catalytic converter and diesel particulate trap industry. The mounting mats are operable as resilient supports in a thin profile, providing case of handling, and in a flexible form, so as to be able to provide a total wrap of the catalyst support structure, if desired, without cracking. Alternatively, the mounting mat may be integrally wrapped about the entire circumference or perimeter of at least a portion of the catalyst support structure.

The mounting mats described above are also useful in a variety of applications such as conventional automotive catalytic converters for, among others, motorcycles and other small engine machines, and automotive preconverters, as well as high temperature spacers, gaskets, and even future generation automotive underbody catalytic converter systems. Generally, they can be used in any application requiring a mat or gasket to exert holding pressure at room temperature and, more importantly, to provide the ability to maintain the holding pressure at elevated temperature, including during thermal cycling.

The mounting mats described above can also be used in catalytic converters employed in the chemical industry which are located within exhaust or emission stacks, including those which contain fragile honeycomb type structures that need to be protectively mounted.

Tough inorganic fiber aggregates wet laid after opening the fiber bundles as described above, are also useful in a variety of applications, such as for insulation and/or fire protection products, for example, insulating or fire resistant blankets, papers, and felts.

A first embodiment provides a method of treating tough inorganic fiber bundles comprising opening a plurality of the tough inorganic fiber bundles such that tough inorganic fibers can be dispersed in a liquid slurry to lay down a homogenous fiber aggregate, wherein the tough inorganic fibers have a crush settle volume of greater than 250 ml, optionally greater than 450 ml.

The method of the first embodiment may further include that opening a plurality of tough inorganic fibers comprises wet opening and/or dry opening the tough inorganic fibers. Wet opening the tough inorganic fibers may comprise at least one of: (i) disc refining the tough inorganic fibers; (ii) de-flaking the tough inorganic fibers; (iii) hydropulping the tough inorganic fibers; or (iv) beating the tough inorganic fibers. Dry opening the tough inorganic fibers may comprise at least one of: (i) carding the tough inorganic fibers; or (ii) milling the tough inorganic fibers, optionally with at least one of an attrition mill combination fiber picker, a hammer mill, or a granular cutting mill.

The method of the first embodiment, or any of the subsequent embodiments, may further include chopping the tough inorganic fibers prior to opening the tough inorganic fibers. Chopping the tough inorganic fibers may comprise die cutting, guillotine chopping and/or water jet cutting the tough inorganic fibers.

The method of the first embodiment, or any of the subsequent embodiments, may further include substantially maintaining the length of the tough inorganic fibers and/or chopped tough inorganic fibers while opening the tough inorganic fiber bundles.

The method of the first embodiment, or any of the subsequent embodiments, may further include that the tough inorganic fiber slurry dilution comprises a dilution of about 0.1% to about 2%, optionally about 0.1% to about 1%.

The method of the first embodiment, or any of the subsequent embodiments, may further include that the opened tough inorganic fibers comprise: (i) the fiberization product of about 72 to about 99 weight percent alumina and about 1 to about 28 weight percent silica; and/or (ii) high alumina fibers; and/or (iii) at least one of carbon fibers, glass fibers, quartz fibers or silica fibers.

In a second embodiment, a method for making a mounting mat for an exhaust gas treatment device comprises preparing a slurry of the opened tough inorganic fibers of any one of the first or subsequent embodiments and a liquid, and removing at least a portion of said liquid from the slurry to form a wet-laid layer containing the opened tough inorganic fibers.

The method for making a mounting mat for an exhaust gas treatment device of the second embodiment may further include mixing in the layer with the opened tough inorganic fibers, at least one additional type of inorganic fibers comprising at least one of ceramic fibers or alkaline earth silicate fibers.

The method for making a mounting mat for an exhaust gas treatment device of the second embodiment, or subsequent embodiment, may further comprise mixing in the layer with the opened tough inorganic fibers, an intumescent material comprising at least one of unexpanded vermiculite, ion exchanged vermiculite, heat treated vermiculite, expandable graphite, hydrobiotite, water-swelling tetrasilicic flourine mica or alkaline metal silicates.

In a third embodiment, a mounting mat comprises the layer of opened tough inorganic fibers prepared according to any one of the second, or subsequent embodiments.

In a fourth embodiment, a exhaust gas treatment device comprises: a housing; a fragile structure resiliently mounted within the housing; and the mounting mat of the third embodiment disposed in a gap between the housing and the fragile structure.

A fifth embodiment provides a method of treating tough inorganic fiber bundles comprising dispersing a plurality of the tough inorganic fiber bundles in a slurry with a dilution of about 0.1% to about 2%, optionally about 0.1% to about 1%, effective to lay down a homogenous fiber aggregate, wherein the tough inorganic fibers have a crush settle volume of greater than 250 ml, optionally greater than 450 ml.

The method of the fifth embodiment may further include cutting the tough inorganic fiber bundles prior to said dispersing the tough inorganic fiber bundles.

The method of the fifth embodiment or subsequent embodiment may further include that the tough inorganic fibers comprise: (i) the fiberization product of about 72 to about 99 weight percent alumina and about 1 to about 28 weight percent silica; and/or (ii) high alumina fibers; and/or (iii) at least one of carbon fibers, glass fibers, quartz fibers or silica fibers.

In a sixth embodiment, a method for making a mounting mat for an exhaust gas treatment device comprises preparing a slurry of the tough inorganic fibers according to any one of the fifth or subsequent embodiments, and removing at least a portion of said liquid from the slurry to form a wet-laid layer containing the tough inorganic fibers.

The method for making a mounting mat of the sixth embodiment may further include mixing in the layer with the tough inorganic fibers, at least one additional type of inorganic fibers comprising at least one of ceramic fibers or alkaline earth silicate fibers.

The method for making a mounting mat of the sixth embodiment or subsequent embodiment may further include mixing in the layer with the tough inorganic fibers, an intumescent material comprising at least one of unexpanded vermiculite, ion exchanged vermiculite, heat treated vermiculite, expandable graphite, hydrobiotite, water-swelling tetrasilicic flourine mica or alkaline metal silicates.

In a seventh embodiment, a mounting mat comprises the layer of tough inorganic fibers prepared according to the sixth, or subsequent embodiments.

In an eighth embodiment, a exhaust gas treatment device comprises: a housing; a fragile structure resiliently mounted within the housing; and the mounting mat of the seventh embodiment disposed in a gap between the housing and the fragile structure.

The embodiments described above are not necessarily in the alternative, as various embodiments may be combined to provide the desired results.

The invention claimed is:

1. A method of treating tough inorganic fiber bundles comprising opening a plurality of the tough inorganic fiber bundles such that tough inorganic fibers can be dispersed in a liquid slurry to lay down a homogenous fiber aggregate, wherein the tough inorganic fibers comprise the fiberization product of 72 to 99 weight percent alumina and 1 to 28 weight percent silica, wherein said opening comprises mechanically altering the tough inorganic fibers and/or fiber bundles, and wherein the tough inorganic fibers have a crush settle volume of greater than 250 ml.

2. The method of claim 1, wherein opening a plurality of tough inorganic fibers comprises wet opening and/or dry opening the tough inorganic fibers.

3. The method of claim 2, wherein wet opening a plurality of tough inorganic fibers comprises disc refining the tough inorganic fibers.

4. The method of claim 2, wherein wet opening a plurality of tough inorganic fibers comprises de-flaking the tough inorganic fibers.

5. The method of claim 2, wherein wet opening a plurality of tough inorganic fibers comprises hydropulping the tough inorganic fibers.

6. The method of claim 2, wherein wet opening a plurality of tough inorganic fibers comprises beating the tough inorganic fibers.

7. The method of claim 2, wherein dry opening a plurality of tough inorganic fibers comprises carding the tough inorganic fibers.

8. The method of claim 2, wherein dry opening a plurality of tough inorganic fibers comprises milling the tough inorganic fibers.

9. The method of claim 8, wherein milling a plurality of tough inorganic fibers comprises milling the tough inorganic fibers with at least one of: (i) an attrition mill combination fiber picker; (ii) a hammer mill; or (iii) a granular cutting mill.

10. The method of claim 1, further comprising chopping the tough inorganic fibers prior to opening the tough inorganic fibers.

11. The method of claim 10, wherein chopping the tough inorganic fibers comprises die cutting, guillotine chopping and/or water jet cutting the tough inorganic fibers.

12. The method of claim 10, further comprising substantially maintaining the length of the chopped tough inorganic fibers while opening the tough inorganic fiber bundles.

13. The method of claim 1, further comprising substantially maintaining the length of the tough inorganic fibers while opening the tough inorganic fiber bundles.

14. The method of claim 1, wherein the tough inorganic fiber slurry dispersion comprises a dispersion of 0.1% to 2%.

15. The method of claim 1, wherein the tough inorganic fibers further comprise high alumina fibers.

16. The method of claim 1, wherein said tough inorganic fibers further comprise at least one of carbon fibers, glass fibers, quartz fibers or silica fibers.

17. The method of claim 1, wherein the tough inorganic fibers have a crush settle volume of greater than 450 ml.

18. The method of claim 1, wherein the tough inorganic fiber slurry dispersion comprises a dilution of 0.1% to 1%.

19. A method of treating tough inorganic fiber bundles comprising dispersing a plurality of the tough inorganic fiber bundles in a slurry with a dilution of 0.1% to 2%, effective to lay down a homogenous fiber aggregate, wherein the tough inorganic fibers comprise the fiberization product of 72 to 99weight percent alumina and 1 to 28 weight percent silica, wherein said opening comprises mechanically altering the tough inorganic fibers and/or fiber bundles, and wherein the tough inorganic fiber has a crush settle volume of greater than 250 ml.

20. A method for making a mounting mat for an exhaust gas treatment device comprising treating tough inorganic fiber bundles according to the method of claim 1 and preparing a slurry of the opened tough inorganic fibers and a liquid, and removing at least a portion of said liquid from the slurry to form a wet-laid layer containing the opened tough inorganic fibers.

21. The method for making a mounting mat for an exhaust gas treatment device of claim 20, comprising mixing in the layer with the opened tough inorganic fibers, at least one additional type of inorganic fibers comprising at least one of ceramic fibers or alkaline earth silicate fibers.

22. The method for making a mounting mat for an exhaust gas treatment device of claim 20 comprising mixing in the layer with the opened tough inorganic fibers, an intumescent material comprising at least one of unexpanded vermiculite, ion exchanged vermiculite, heat treated vermiculite, expandable graphite, hydrobiotite, water-swelling tetrasilicic flourine mica or alkaline metal silicates.

23. The method according to claim 19, comprising dispersing a plurality of the tough inorganic fiber bundles in a slurry with a dilution of 0.1% to 1%, effective to lay down a homogenous fiber aggregate, wherein the tough inorganic fiber has a crush settle volume of greater than 450 ml.

24. The method of claim 19, comprising cutting the tough inorganic fiber bundles prior to said dispersing the tough inorganic fiber bundles.

25. The method of claim 19, wherein the tough inorganic fibers further comprise high alumina fibers.

26. The method of claim 19, wherein said tough inorganic fibers further comprise at least one of carbon fibers, glass fibers, quartz fibers or silica fibers.

27. A method for making a mounting mat for an exhaust gas treatment device comprising preparing a slurry of the tough inorganic fibers according to claim 19, and removing at least a portion of said liquid from the slurry to form a wet-laid layer containing the tough inorganic fibers.

28. The method for making a mounting mat for an exhaust gas treatment device of claim 27, comprising mixing in the layer with the tough inorganic fibers, at least one additional type of inorganic fibers comprising at least one of ceramic fibers or alkaline earth silicate fibers.

29. The method for making a mounting mat for an exhaust gas treatment device of claim 27 comprising mixing in the layer with the tough inorganic fibers, an intumescent material comprising at least one of unexpanded vermiculite, ion exchanged vermiculite, heat treated vermiculite, expandable graphite, hydrobiotite, water-swelling tetrasilicic flourine mica or alkaline metal silicates.

* * * * *